US010604284B2

(12) United States Patent
Pierson et al.

(10) Patent No.: US 10,604,284 B2
(45) Date of Patent: Mar. 31, 2020

(54) STRETCH WRAPPING APPARATUS AND METHOD

(71) Applicant: Top Tier, LLC, Clackamas, OR (US)

(72) Inventors: Cary Michael Pierson, Milwaukie, OR (US); Nathaniel T. Schenk, Clackamas, OR (US); Stephen L. Heston, West Linn, OR (US)

(73) Assignee: Top Tier, LLC, Clackamas, OR (US)

( * ) Notice: Subject to any disclaimer, the term of this patent is extended or adjusted under 35 U.S.C. 154(b) by 227 days.

(21) Appl. No.: 15/891,421

(22) Filed: Feb. 8, 2018

(65) Prior Publication Data

US 2018/0162568 A1 Jun. 14, 2018

Related U.S. Application Data

(62) Division of application No. 14/471,932, filed on Aug. 28, 2014, now Pat. No. 9,896,229.

(51) Int. Cl.

| | |
|---|---|
| ***G06F 7/00*** | (2006.01) |
| ***B65B 11/04*** | (2006.01) |
| ***B65B 57/04*** | (2006.01) |
| ***B65B 41/12*** | (2006.01) |

(52) U.S. Cl.

CPC ..... *B65B 11/045* (2013.01); *B65B 41/12* (2013.01); *B65B 57/04* (2013.01)

(58) Field of Classification Search

None

See application file for complete search history.

(56) References Cited

U.S. PATENT DOCUMENTS

| | | | | |
|---|---|---|---|---|
| 5,794,406 | A * | 8/1998 | Reichental | B29C 44/182 53/113 |
| 2007/0204564 | A1* | 9/2007 | Lancaster, III | B65B 11/006 53/399 |
| 2014/0075887 | A1* | 3/2014 | Akpan | B65B 5/04 53/430 |

* cited by examiner

*Primary Examiner* — Yolanda R Cumbess

(74) *Attorney, Agent, or Firm* — Hancock Hughey LLP

(57) ABSTRACT

A stretch wrapping apparatus is adapted for use with an automated palletizing machine to securely stabilize loads prepared by the palletizing machine. The stretch wrapping machine works with a rotatable turntable on which the palletized load is placed. A stretch wrapping head feeds pre-stretched wrapping film toward the rotating load and air jets blow the tail of the film onto the load. Relative rotational movement is created between the wrapping head and the load and the free end of the film is unsupported by any mechanical structure and is directed toward the load only with air from the jets. The film attaches to an outer surface the load and the wrapping head moves vertically so that the load is helically wrapped. Film is dispensed at a rate to provide payout of film that is consistent with the demand as each load corner transitions through its relative distance change from the dispensing point based on calculations intervals. A sensor detects changes in the optical character of the film—defects—to determine an out of bounds condition such as a film break. A film cutter arm assembly uses a hot wire and press rolls to cut the film when the load is wrapped.

20 Claims, 5 Drawing Sheets

STRETCH WRAPPING APPARATUS AND METHOD

TECHNICAL FIELD

The present invention relates to apparatus and methods for wrapping a load, and more specifically, wrapping a palletized load of items with stretch wrapping material.

BACKGROUND

Stretch wrapping is a commonly used method of protecting palletized loads of material for shipping. Described generally, stretch wrapping involves wrapping a specialized film around a stack of items such as cases that have been arranged on a pallet. The film is wrapped around the cases under tension and thereby stabilizes the stack to minimize the risk of damage during shipping. Tension can be provided by the memory recovery of pre-stretched film, and tension may also be created by resistance between the load and film dispenser or a combination of the two.

There are many styles and designs of automated or semi-automated stretch wrapping machines, many of which work in cooperation with automated palletizing machines that build the palletized loads. The stretch wrapping machines provide relative rotation between the palletized load and a dispenser that holds a roll of stretch wrapping film. Typically, either the pallet and load are stationary with the dispenser rotating around the load, or the pallet and load are rotated relative to a stationary dispenser. Either way, the stretch wrapping film is wrapped helically up and down the load under tension to stabilize it.

Stretch wrapping machines are used in highly automated production and packaging lines and must be able to keep up with throughput rates of the other equipment used in the palletizing operation so that the stretch wrapping operation does not slow the overall production. As such, the devices often operate at relatively high production rates themselves. But stretch wrapping is not always a simple operation. For example, it is known that with a rectangular load on a pallet the demand for the stretch wrapping film varies as the corners of the load pass by the film dispensing point: the payout demand for film increases as the corner of the load passes the dispensing point and decreases as the film is being dispensed across the side of the load between corners. In addition to the payout rate, the amount of tension on the film has a direct impact on the stability of the load when completely wrapped. Many stretch wrapping machines use tensioning devices to control the tension on the film. However, tension forces vary with rotational position and as a result, proper tensioning is often difficult to maintain with high throughput rates. When the film breaks for any number of reasons (including excessive tension), the operation of the stretch wrapping device is stopped or slowed while the film is reattached to the load, either automatically or with operator intervention.

There is an ongoing need for improved stretch wrapping devices that balance the needs and challenges of keeping up with production rates while wrapping loads with proper film tension to correctly stabilize the loads.

The present invention comprises an improved apparatus and method for automated stretch wrapping of a palletized load.

BRIEF DESCRIPTION OF THE DRAWINGS

The invention will be better understood and its numerous objects and advantages will be apparent by reference to the following detailed description of the invention when taken in conjunction with the following drawings.

DETAILED DESCRIPTION OF THE ILLUSTRATED EMBODIMENTS

The primary structural components of stretch wrapping apparatus 10 are described first with reference to the drawings. Operational characteristics and functions are then described.

Figure 1:
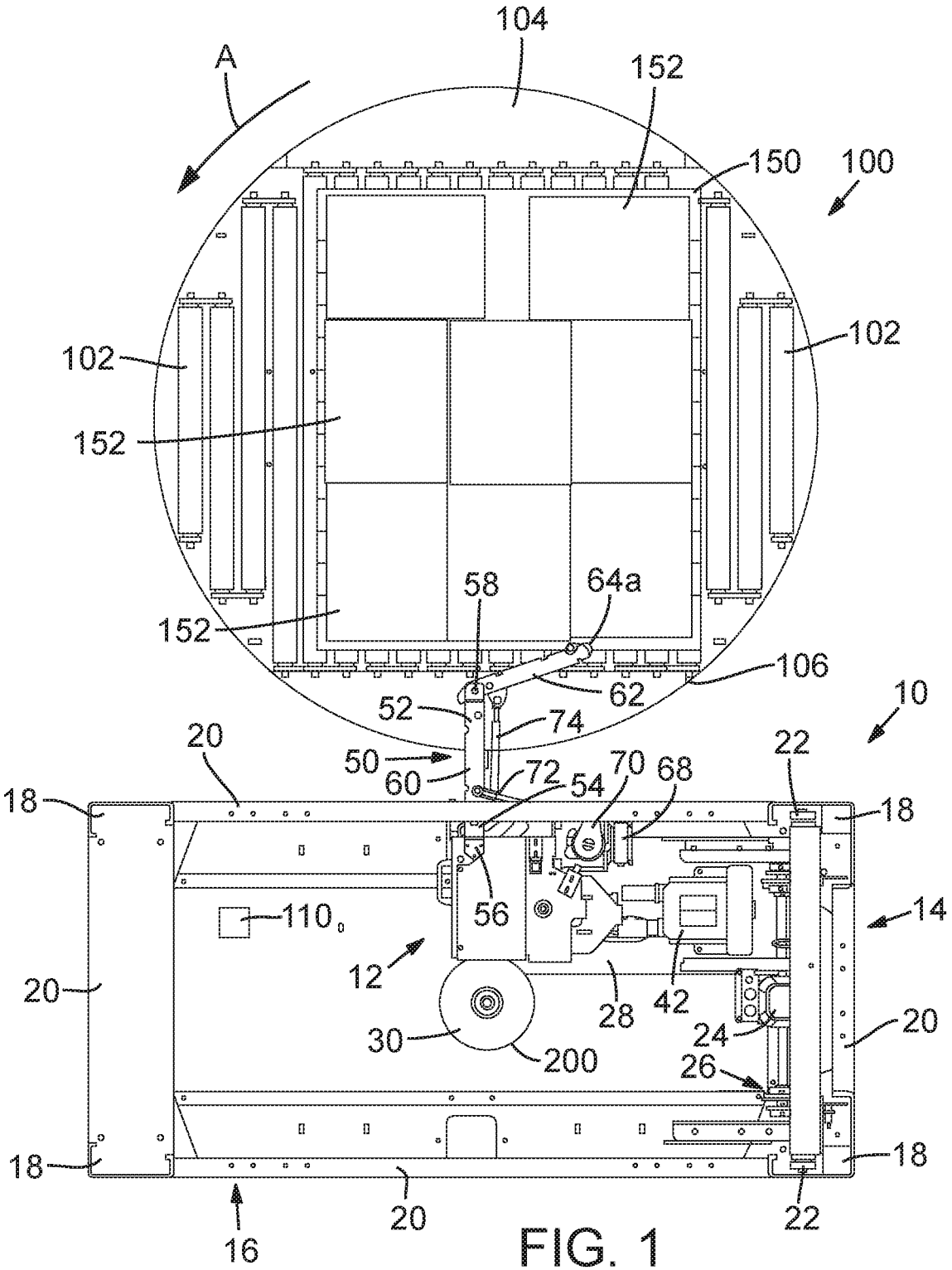
FIG. 1 is a top plan view of a stretch wrapping apparatus according to the present invention, showing the stretch wrapping head mounted in its frame and positioned adjacent to a turntable on which a palletized load is positioned.

Stretch wrapping apparatus 10 generally comprises a stretch wrapping head assembly 12 that is mounted to a carriage assembly 14 that is vertically reciprocally mounted on a frame 16. A turntable 100 is located immediately adjacent stretch wrapping head assembly 12. As seen in FIG. 1, a pallet 150 is operatively positioned on turntable 100 and carries a completed stack of palletized boxes 152. Frame 16 includes vertical corner posts 18 that are interconnected with top rails 20. Carriage assembly 14 defines a movable carriage on which stretch wrapping head assembly 12 is mounted and includes guide rollers 22 that are received in vertical tracks formed in the corner posts 18 in a conventional manner. A carriage lift drive motor 24 is mounted to the carriage assembly 14 and drives vertical reciprocal movement of the carriage assembly with a conventional carriage hoist chain assembly 26.

Stretch wrap head assembly 12 comprises components described below, which are mounted to a horizontal support member 28 that is mounted to carriage assembly 14 so that vertical movement of the carriage assembly directly moves the stretch wrap head assembly. A roll 30 of stretch wrap film 200 is mounted on a mandrel on the support member 28 with the longitudinal axis of the roll vertically oriented relative to the ground plane. A film pre-stretch assembly shown generally at 32 is adjacent the roll 30 and includes a pre-stretch drive motor 34 that drives pair of vertically oriented pre-stretch drive rollers 36. A film guide roller 38 is between the drive rollers 36. In some instances and installations more than one pair of pre-stretch rollers 36 may be used.

The driven rollers 36 define the active film payout mechanism for dispensing the film 200. Film 200 is fed over the film guide roller 38 and then through driven rollers 36. A film sensor 40 is positioned downstream of the film drive rollers 36 and is an optical sensor that detects the presence (or absence) of film and optionally, the relative condition of the film, as detailed below. When pre-stretch film dispensing occurs, the drive rollers rotate at different speeds which pre-stretches film between the adjacent rollers. Non pre-stretch dispensers generally use one driven roller or using relative motion between the load and dispenser, film is pulled directly from the roll that usually has some type of friction clutch to create film tension.

A blower motor 42 is mounted to support member 28 and is plumbed via an air tube that splits and feeds two vertically oriented and parallel film training air jet tubes 44 and 46. The air jet tubes 44 and 46 include plural air jets 48, which are openings through which pressurized air supplied by blower motor 42 is directed in a jet onto film 200, as detailed below, as the film is blown toward the boxes 152 on pallet 150. The air jet tubes 44 and 46 are positioned immediately downstream of the film drive rollers 36 such that film 200 being fed through and traveling through the drive rollers is fed between the two air jet tubes.

Stretch wrap head assembly 12 further comprises a film cut arm assembly 50 that comprises a jointed arm 52 pivotally mounted at its first end 54 to a bracket 56 and having a pivot joint 58 midway along the length of the arm. The jointed arm thus defines a first arm section 60 (the inboard section) and a second arm section 62 pivotally mounted to the first arm section 60. At the distal or outboard end of the second arm section 62 a pair of vertical rolls 64*a* and 64*b* are mounted and a film cut hot wire 66 is strung between the rolls 64*a* and 64*b* such that the hot wire is coincident with the outer tangent between the two rolls 64. Considering the direction of load rotation on turntable 100 (i.e., arrow A, FIG. 1), roll 64*a* is considered to be the downstream roll and roll 64*b* is thus the upstream roll. A film cut arm drive motor 68 has a bell crank 70 mounted to its output shaft and a connecting rod 72 directly attaches the bell crank 70 to first arm section 60 of the jointed arm 52. A gas strut 74 has its inner end connected near the bracket 56 and its second end attached at a bracket to the second arm section 62.

With returning reference to FIG. 1, turntable 100 comprises plural driven rollers 102 mounted on a rotatable base 104. An encoder is shown schematically at 106 and is mounted to turntable 100. Turntable 100 is rotated in the direction of arrow A in FIG. 1 with a turntable drive motor, which is not shown; encoder 106 may be mounted to the drive motor instead of directly to the turntable. Turntable rotation speed and position is known based on encoder feedback. Other types of position indicator(s) may be substituted for encoder 106.

The stretch wrap apparatus 10 and turntable 100 are under the control of a controller, which is shown schematically at 110. Operation of apparatus 10 will now be described in detail. Certain operational parameters and criteria are programmed into controller 110 for each load, i.e., each pallet of boxes 152 that is being stretch wrapped by apparatus 10.

Those operational parameters and criteria include:

a. The film dispensing point remains at a known distance from the center point of turntable 100. As used herein, the film dispensing point is defined as the tangent of the last roller contacting the film as film is dispensed toward the load;

b. The load being wrapped is positioned centered on the turntable;

c. The finished load size dimensions are known from existing data available from the palletizer controller that is building the load. Therefore, the four corners of the load position relative to the dispensing point are calculated by controller 110;

d. Once the turntable 100 begins to rotate the rotation speed is known by data from encoder 106 and corner positions of the load begin to change relative to the dispensing point. The corner positions are calculated using turntable rotation angle as determined by the encoder 106, dispensing point center distance and load size dimensions;

e. The frequency of calculation intervals to determine corner distance from the dispensing point during a full 360 degree turntable rotation is not necessarily fixed, although a higher frequency of calculation intervals per 360 degrees of rotation may improve performance consistency;

f. The corner of the load initially evaluated for dispensing purposes is the closest corner of the load rotating away from the dispensing point (arrow A, FIG. 1);

g. Once the initially evaluated corner passes a point where film starts to engage the next corner of the load based on turntable rotation direction, that new corner becomes the reference point for calculations. The means of corner transition change is also based on calculations performed by controller 110 and is not a result of feedback from a sensor or other means;

h. Using the load length, width, and the distance between the dispensing point and the center of the turntable, controller 110 automatically determines at what turntable position each corner of the load will engage the film and will become the active corner—the "active corner" being that corner of the load that most recently engaged the film;

i. As turntable rotation occurs, film is dispensed at a rate—a payout rate—to provide payout of film that is consistent with the speed the active corner moves away from the dispensing point, hereafter referred to as the demand rate. The demand rate is calculated using the dimensions of the load, the instantaneous position of the turntable, the distance from the center of the turntable to the dispensing point, and the instantaneous speed the turntable is rotating. The rate at which pre-stretched film is paid out by pre-stretch rollers 36 is based on calculated demand (the demand rate) while the presence (and optionally, characteristics) of the film are confirmed by sensor 40. Stated another way, the known rotational speed of the turntable is a variable along with the corner positions of the load to be wrapped relative to the dispensing point so that a calculation of demand rate may be made, and so that film payout rate is controlled to be the same as or near the same as demand rate. In practice there may be variance between the calculated actual demand rate and the film payout rate. However, in all cases the film payout rate is consistent with the demand rate so that the load is not disrupted or displaced by film attachment to the load, or ongoing wrapping;

j. Data used in calculation can be offset from actual to provide compensation for control reaction latency in a forward looking anticipatory manner if needed;

k. Actual calculated film dispensing rates can also be varied with offsets or multiplication factors to slightly increase or decrease payout relative to calculated values;

l. Dispensing film payout at a rate matching or closely matching instantaneous demand of the load being wrapped by mathematically tracking the change in the load's active corner position relative to the dispensing point;

m. Mathematically compensating for helix as the carriage assembly 14 moves vertically relative to the load by tracking the change in film head height relative to the height the film was at when the active corner engaged the film;

n. Applying a post-stretch factor to the result of the above calculations to increase or decrease tension between the load and the pre-stretch head.

o. Should the load not be centered on the turntable, offsetting calculations can be made to compensate and maintain the sequence above. For example, where the load is not centered on the turntable the center of load position is used, and combined with the center of turntable position for load demand calculations.

p. Should load size characteristics not be known from the palletizer or other systems, sensors can be used to determine load size and position on the turntable or operator input at an operator interface station can be used.

With the foregoing parameters being set, the stretch wrapping procedure begins with a pallet 150 having a completed stack of boxes 152 positioned thereupon is moved onto the center of turntable 100 with the assistance of driven rollers 102. The load dimensions are known by controller 110, the data having been transmitted to the controller from the controllers used in the upstream palletizing operation. Blower motor 42 is operating and pressurized air is being blown out of air jets 40 onto a free end of film 200 that is being fed through the pre-stretch drive rollers 36 and through the dispensing point between the air tubes 46 and 48—the free or loose end—i.e., the "tail" of the film 200 is unsupported other than the "support" provided by the pressurized air that is being trained on the film. The tail of the film is thus blown toward the load. Said another way, there are no film gripping systems or film engagement devices associated with controlling the attachment of the film to the load, either initially or later, for example after a break in the film.

During pre-attachment, the film is dispensed by the pre-stretch rollers 36 at the rate at which the film would be dispensed if the film was attached to the load. That payout rate is determined by the controller 100 using the known load dimensions and the known speed at which the load is rotating on the turntable. As the film is paid out by the pre-stretch drive rollers 36 the tail of the film makes contact with a surface of the load that is rotating on the turntable—as noted below, the surface that the film contacts may be a side surface or an upper corner surface. Contact between the film and the load is sustained by the continuous flow of air being blown onto the film and the film attaches to the load after it makes contact, either directly or by virtue of sustained contact between the film and the load. In some instances, depending upon a variety of factors such as environmental factors, the nature of the load, etc., the load may rotate through a complete rotation or more before the film attaches to the load. However, the film will attach given the sustained and continuous air stream from the blower that pushes the film against an outer surface of the load, such that the film makes sustained contact with the load as it rotates. Because the film is being paid out at the rate that would nominally match the demand based on load position, size and rotational speed, when the film ultimately engages the load there is no sudden film tension or pull that can prevent engagement or cause the film to break.

The vertical position of carriage assembly may be initially located near the upper limit of the load so that the tail of the film 200 attaches near the top or on one of the upper corners of the boxes 152. The film is then wrapped in a downward helix; the carriage assembly is moved downward as the turntable rotates. Equally well, the tail of the film 200 may be blown onto a side of the load where it catches quickly in most instances to begin the wrapping operation; the carriage is reciprocated vertically as required to wrap the load. Regardless of the position at which the film tail contacts the load, i.e., on a side surface or an upper corner surface, the film attaches because it is continuously blown into contact with an outer surface of the load by the air from the blower. This may be contrasted with the prior art, where film was blown toward a stationary load and where the film was secured to the load by virtue of capturing the film between the cases and the pallet, or between layers of the cases. In other words, prior uses of air to blow film toward a load required the weight of the load to secure the film between one inner surface (e.g., the pallet or an upper surface of an intermediate layer of cases) and another inner surface (e.g., the lower surface of layer of cases).

Stretch wrap apparatus 10 does not include any tension feedback for controlling or varying the tension applied to film 200 as it is wrapped around the load, and there is no sensor feedback required after the film 200 exits the pre-stretch rollers such as a film break sensor. Nonetheless, sensor 40 does sense if film 200 is not exiting the pre-stretch assembly 32 because the character of the film momentarily changes. As noted, sensor 40 is an optical sensor that is capable of detecting presence and optionally the position or character of film 200. If sensor 40 detects that film is no longer exiting the pre-stretch assembly, it indicates it is likely that the film 200 on roll 30 has run out, or there is some other failure. Optionally, a different type of sensor can be used in place of sensor 40 to detect if the film is actually attached to the load, or detect defects such as partial film tears or holes in the film based on optical characteristics described below. When there is, for example, a break in the film the film flutters in the air streams being blown onto the film. This causes changes in the optical characteristics "seen" by sensor 40 and this is indicative of an out of bounds situation. Further, the sensor 40 senses engagement of the tail of the film to the load by continuous monitoring of the integrity of the film web between the pre-stretch assembly 32 and the load. If film web integrity has been compromised, the problem is detected by sensor 40 (again, by optical characteristic changes) and action will automatically be taken via controller 110 to insure load containment by dispensing additional film in the area of the load where the film defect was encountered in order to, for example, overwrap the portion of the load where the break occurred to insure complete film wrapping of the entire load. Sensor 40 is described above as an optical sensor, but other sensor technologies exist that may be used instead, such as ultrasonics.

Blower motor 42 is operated continuously during the entire stretch wrapping cycle for a load, beginning with blowing the tail of the film 200 onto the load for its initial attachment and continuing until the load is completely wrapped and the film is cut, as described below. In the event of a break in the film during the wrapping cycle, the air stream trained onto the new tail of the film 200 causes the film to reattach to the load so that wrapping continues until complete. In addition, in the event of a break the film wrap sequence is adjusted to overwrap the portion of the load where the film break has occurred. This insures that the entire load is stabilized and contained with film and may involve adjustment of the vertical position of carriage assembly. The blower system combined with the payout system thus defines an automatic film re-engagement device for recovery from film breaks.

Film training from the blower may be turned off as an energy savings measure if desired after film engagement and reenergize should sensor 40 sense an out of bounds condition.

Figure 2:
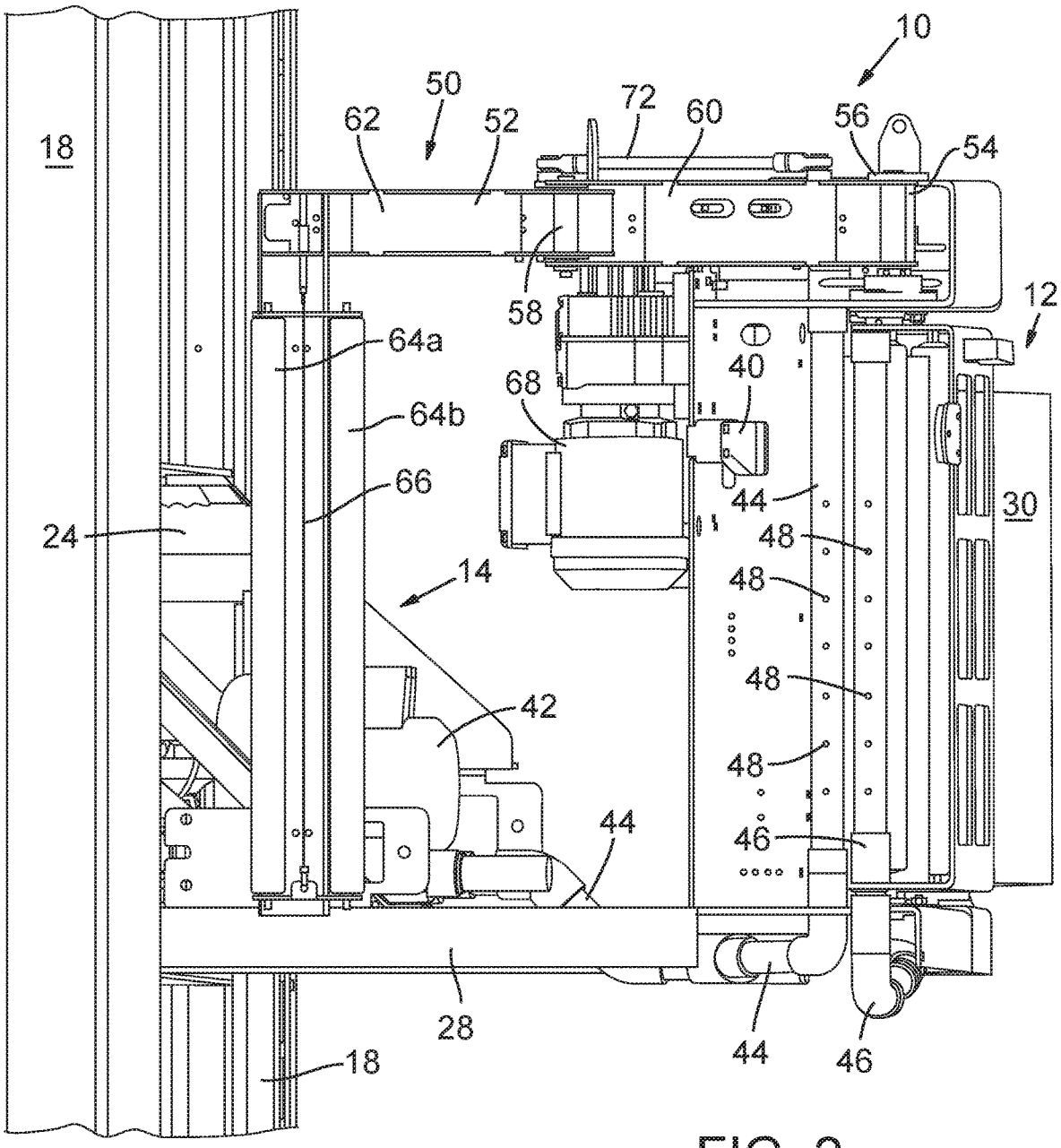
FIG. 2 is side elevation view of the stretch wrapping head and carriage assembly, illustrating portions of the mounting frame.
Figure 3:
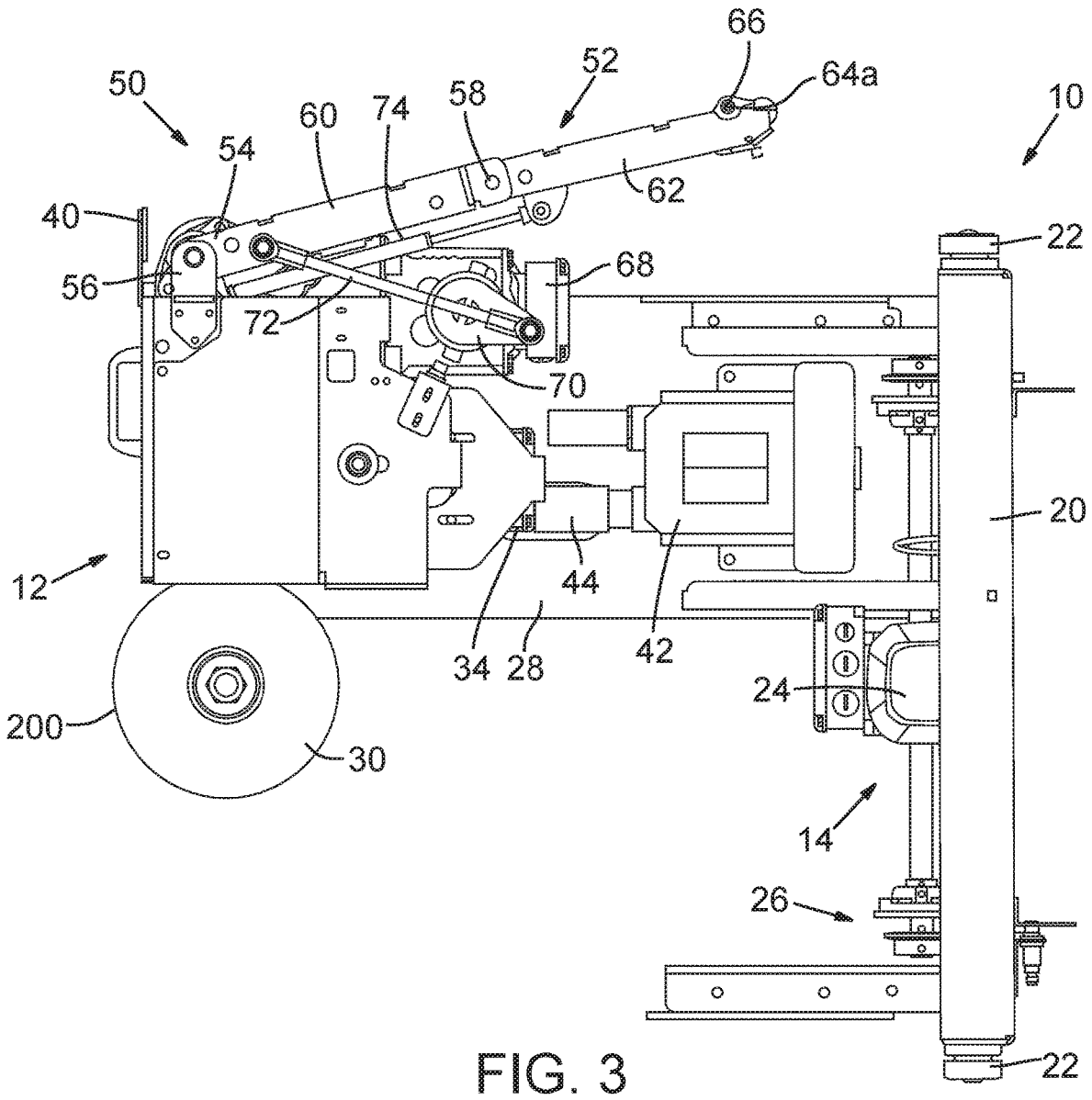
FIG. 3 is a top plan view of the stretch wrapping head and carriage assembly shown in FIG. 2, with the frame elements removed.
Figure 4:
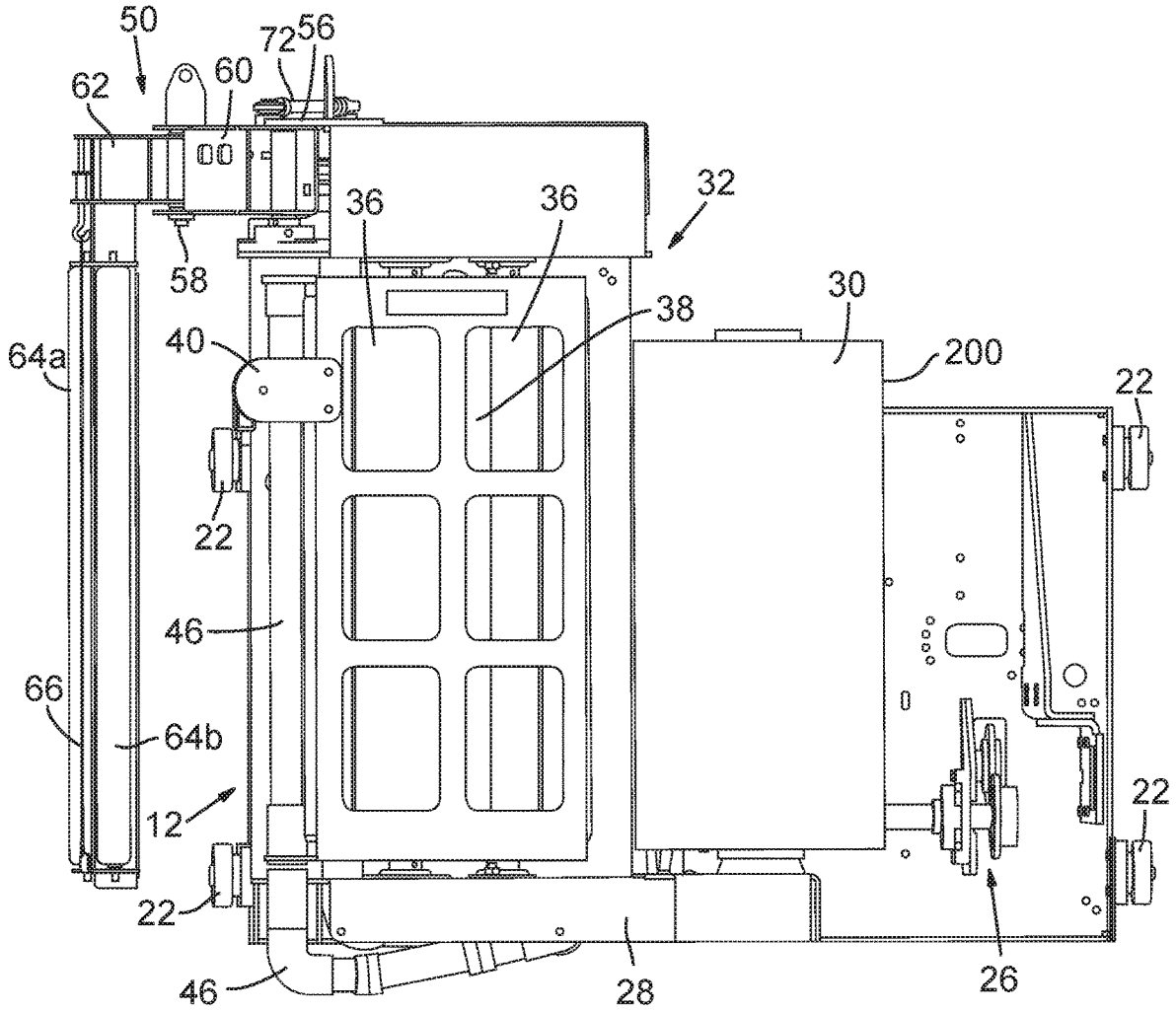
FIG. 4 is a front elevation view of the stretch wrapping head and carriage assembly shown in FIG. 3.

Once the load is completely wrapped the film 200 is cut by operation of cut arm assembly 50. The cut arm assembly 50 is shown in various positions in the drawings. In FIGS. 2, 3 and 4 the arm 52 is shown in its "home" position. In FIG. 1 the cut arm 52 is shown engaging the load after it is wrapped. In this position the downstream roller 64*a* is in contact with the film 200 after it is wrapped around the load but upstream roller 64*b* may or may not be in contact with the load. After the load is wrapped, the pressure applied to the film by roller 64*a* acts as a method of pressing the film against the load during film cut and wipe-down in combination with a brush not shown.

The cut arm 52 swings out from the home position (FIG. 2) with drive motor 68, which as noted is attached to the first end 54 of cut arm 52 with connecting rod 72, which is in turn connected to bell crank 70. As the cut arm swings from its home position the downstream roller 64*a* makes contact with the load (as shown in FIG. 1) and upon contact with the load the outer portion of arm 52 (i.e., second arm section 62) pivots against gas strut 74. Pressure from gas strut 74 keeps the roller 64*a* arm in contact with the load. When the second arm section 62 is at about 90 degrees to the carriage assembly 14 (FIG. 1) and the wrapping cycle is complete, the hot cut wire 66 is energized, heating the wire and thereby cutting the film while the cut arm 52 continues to swing to its end of travel of about 170 degrees. At this point the film 200 is deflected across the upstream and downstream rollers 64*a* and 64*b*; the close proximity of the hot wire 66 to the film, even if no actual contact is made between the film and the wire, causes the film to be cut. Moreover, avoiding direct contact between the wire and the film can be advantageous to avoid residual melted film from building up on the wire. The downstream roll 64*a* contacts the load and thus presses the cut edge of the film onto the load and this avoids a loose film end. A wiper brush (not shown) is included downstream of the downstream roller 64*a* to ensure that the cut end of the film is pressed down on the load.

Figure 5:
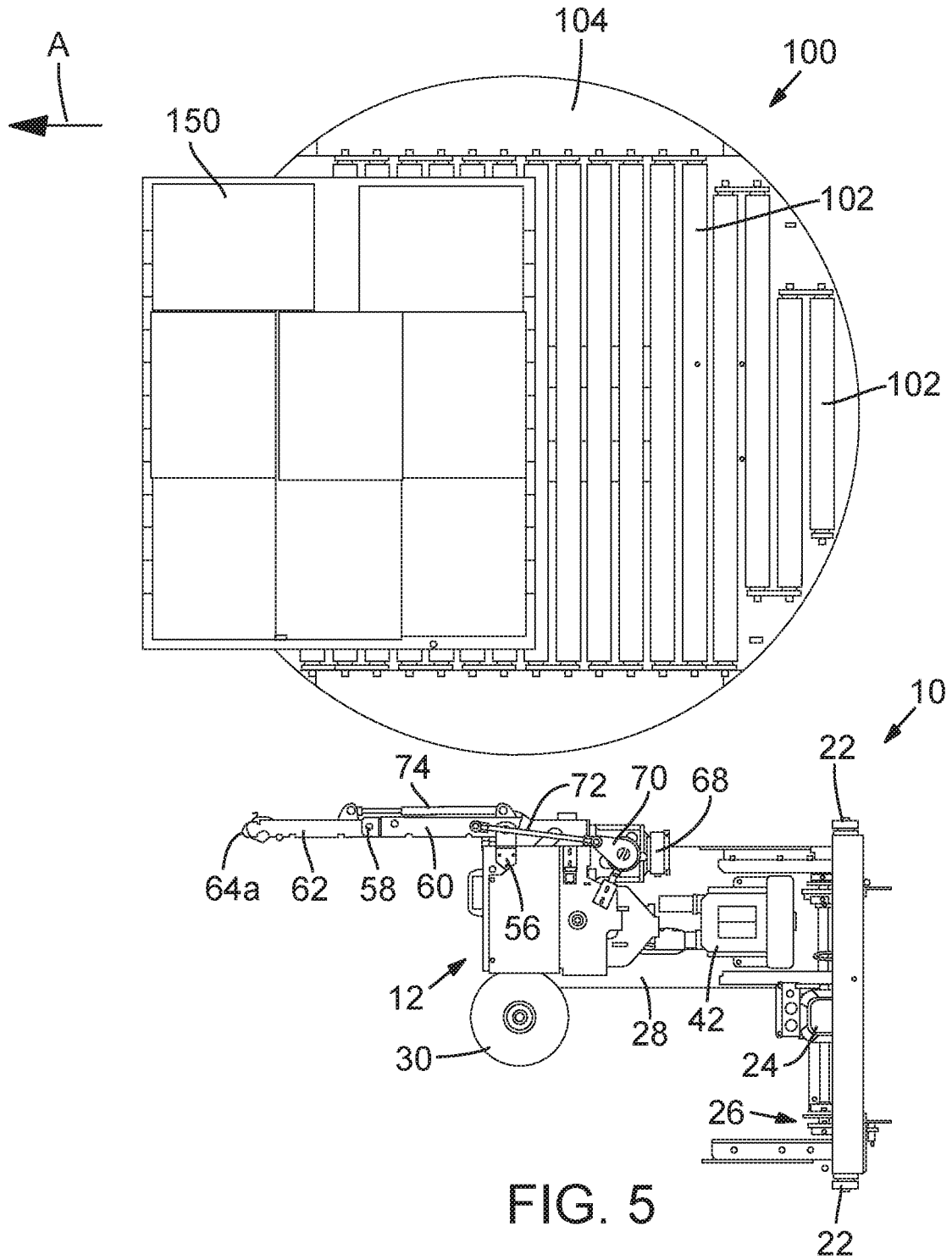
FIG. 5 is a top plan view of a stretch wrapping apparatus similar to the view of FIG. 1, except in FIG. 5 the stretch wrapping is complete and the film has been cut by the cut arm and the palletized load is exiting from the turntable.

Once cut arm 52 is at the end of its travel as shown in FIG. 5, the load starts to exit the turntable (driven off the turntable with driven rollers 102 in the direction of arrow A). The cut arm 52 is then free to swing back after the load has passed to its home position. The drive motor 68 and thus the bell crank 70 each do one complete revolution per full cut arm 52 cycle. This system is fast and provides an excellent cut and wipe regardless of the load size. The arm geometry allows wiping loads anywhere from 52×52 inches to 30×30 inches without any adjustment with the film cut preferably occurring at approximately the center of the side exposed to the cut arm, but adjustable to any point where the film cut arm is contacting the film. The load contacting rollers 64*a* and 64*b* have dual purposes: first, they provide rotational low friction contact with the load, and second, they provide protection for the heated cut wire that resides between the rollers.

By comparing the position of the cut arm 52 in its home position in FIG. 1 versus the exit position of FIG. 5, it may be seen that the arm is capable of traveling through an arc of about 170 degrees; this arc is facilitated by the articulating joint 58 between the first and second arm sections 58 and 60. In this arc the roll 64*a* goes from an engaged position with the load to a non-engaged position and the arc self-adjusts while in the engaged position to maintain pressure on the load as it rotates relative to the arm.

Those of skill in the art will readily appreciate that invention described herein and illustrated in the drawings may be modified in certain manners to create equivalent equipment without departing from the nature of the invention. For example, while the invention has been described as used with a turntable on which a palletized load is positioned, it is equally possible to create the required relative rotational motion between the load and the stretch wrapping head by keeping the load stationary and by rotating the stretch wrapping head around the stationary load. Accordingly, the term rotational axis is used herein to describe the center point for both a of these different methods of creating relative rotation between the load and the head, i.e., (a) where a stationary head used in combination with a rotating load, and (b) where a stationary load used in combination with a rotating head.

As another example, the pre-stretch assembly 32 may be modified such that the last pre-stretch roller (i.e., the most downstream roller in terms of film dispensing direction) is positioned such that film exits the roller without a downstream idler roller. This is done by canting the assembly so that film is fed directly off the last pre-stretch roller into the space between the air tubes 44, 46. As an example of yet another equivalent modification, the blower motor 42 is a source of relatively higher pressure air that is blown through the air jets 48. The higher pressure air may be supplied in numerous additional ways, for instance, a canister of pressurized air to name but one of many examples. Other modifications will be apparent to those of skill in the art.

The present invention has been described in terms of preferred and illustrated embodiments, it will be appreciated by those of ordinary skill that the spirit and scope of the invention is not limited to those embodiments, but extend to the various modifications and equivalents as defined in the appended claims.

The invention claimed is:

1. A method of stretch wrapping a load comprising the steps of:

a) dispensing stretch wrapping film from a film delivery head;

b) providing relative rotation between the film delivery head and the load; and c) as the stretch wrapping film is dispensed from the film delivery head, blowing air toward a free end of the film so that the free end of the film is blown toward an outer surface of the load and makes contact with the outer surface and thereby attaches to the outer surface of said load.

2. The method according to claim 1 including monitoring an optical character of the film and determining that a break in the film has occurred when the optical character of the film changes.

3. The method according to claim 2 including determining if a film break has occurred, and if a film break occurs blowing air on a free end of the film created by the film break while continuing relative rotation between the film delivery head and the load so that the free end of the film reattaches to the outer surface of the load.

4. The method according to claim 1 including vertically moving the film delivery head as the load and the film delivery head are in relative rotation.

5. The method according to claim 1 including the step of controlling and measuring the speed of relative rotation.

6. The method according to claim 5 including determining the dimensions of the load and dispensing film at a film payout rate determined by the dimensions of the load and the measured speed of relative rotation.

7. The method according to claim 6 in which the load has corners and including determining the distance between the delivery head and an axis of relative rotation between the delivery head and the load, and determining a position at which each corner of the load will engage the film web, based upon the known dimensions of the load, and the distance between the delivery head and the axis of relative rotation to thereby define a demand rate, and controlling a film delivery rate so that it is consistent with the defined demand rate.

8. The method according to claim 7 in which an active corner is defined by the corner of the load that has most recently engaged the film as the film is dispensed from the delivery head, and including the step of determining the demand rate based upon the speed at which the active corner moves away from the film delivery head.

9. The method according to claim 8 including the step of monitoring a film delivery head height relative to the load and adjusting the film delivery rate based upon the film delivery head height.

10. The method according to claim 9 including the step of monitoring the presence of said film as said load rotates.

11. The method of claim 1 wherein the film is reattached to the load after the film has broken, and including the following steps:

a. monitoring the film to determine if a break in the film has occurred;

b. if a break in the film has occurred, blowing air on a free end of the film created by the break while dispensing film from the film delivery head.

12. The method according to claim 11 including monitoring an optical characteristic of the film to determining if a break in the film has occurred when the optical character of the film changes.

13. The method according to claim 12 including continuing relative rotation between the film delivery head and the load so that the free end of the film reattaches to the outer surface of the load.

14. A method of stretch wrapping a load comprising the steps of:

a) providing relative rotation between a film delivery head and a load;

b) dispensing film from a film delivery head and attaching the film to an outer surface of the load;

c) monitoring the film to determine if a break in the film occurs; and d) if a break in the film occurs, blowing air toward a free end of the film that results from the break so that the free end of the film is blown toward the outer surface of the load and reattaches to the outer surface of said load.

15. The method according to claim 14 including continuously blowing air toward the film during said relative rotation.

16. The method according to claim 15 including dispensing film at a film payout rate that is independent of a load demand.

17. A method of stretch wrapping a load having corners, the method comprising the steps of a) causing relative rotation between the load and a film delivery head;

b) while the load and the film delivery head are rotation relative to one another, dispensing film from the delivery head and blowing air on a free end of the film as the film is dispensed so that the free end of the film is blown toward an outer surface of the load; and c) causing the film to attach to the outer surface of the load.

18. The method according to claim 17 including the steps of:

a) determining a load demand based on a length and width of the load and the distance between an axis of relative rotation between the load and the delivery head; and b) dispensing said film at a film payout rate that is determined by the load demand.

19. The method according to claim 17 including monitoring the film as relative rotation between the load and the film delivery head occurs and determining if a break in the film has occurred after the film has attached to the outer surface of the load.

20. The method according to claim 19 including, when it has been determined that a break in the film has occurred, the step of reattaching a free end of the film that has resulted from the break in the film to the outer surface of the load by blowing air on the free end of the film.

* * * * *